US007412186B2

(12) United States Patent
Sekovski et al.

(10) Patent No.: US 7,412,186 B2
(45) Date of Patent: Aug. 12, 2008

(54) CLEANING SYSTEM FOR A CHARGING DEVICE IN A XEROGRAPHIC PRINTER

(75) Inventors: David Sekovski, Rochester, NY (US); Robert A. Gross, Penfield, NY (US); John D. McCaffrey, Rochester, NY (US); Michael N. Soures, Webster, NY (US); David K. Ahl, Rochester, NY (US); Douglas A. McKeown, Geneseo, NY (US); Michael G. Petranto, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 327 days.

(21) Appl. No.: 11/228,898

(22) Filed: Sep. 16, 2005

(65) Prior Publication Data

US 2007/0065173 A1 Mar. 22, 2007

(51) Int. Cl.
*G03G 15/02* (2006.01)

(52) U.S. Cl. ..... 399/100; 399/170; 399/171; 399/172; 399/173

(58) Field of Classification Search ..... 399/50, 399/98–100, 170–173
See application file for complete search history.

(56) References Cited

U.S. PATENT DOCUMENTS

| | | | | | |
|---|---|---|---|---|---|
| 3,842,273 | A | * | 10/1974 | Van Buskirk | 399/100 |
| 3,875,407 | A | * | 4/1975 | Hayne | 399/100 |
| 3,891,846 | A | * | 6/1975 | Ito | 399/100 |
| 4,019,055 | A | * | 4/1977 | Derleth | 399/100 |
| 5,485,253 | A | * | 1/1996 | Osbourne | 399/170 |
| 5,485,255 | A | | 1/1996 | Reuschle et al. | |
| 5,532,798 | A | * | 7/1996 | Nakagami et al. | 399/170 |
| 6,449,447 | B1 | | 9/2002 | Regelsberger et al. | |
| 2007/0065172 | A1 | | 3/2007 | Sekovski et al. | |

* cited by examiner

*Primary Examiner*—David M Gray
*Assistant Examiner*—Geoffrey T Evans
(74) *Attorney, Agent, or Firm*—R. Hutter

(57) ABSTRACT

In a xerographic printing apparatus, a charge device is used to apply a charge to a photoreceptor. The shuttle includes a wiper that cleans a sidewall of the charge device. A tab is disposed adjacent the sidewall to retain toner or dirt accumulated by the scraper. The tab is electrically insulative, and effectively covers the accumulated toner or dirt, to lower the possibility of arcing within the charge device.

12 Claims, 3 Drawing Sheets

CLEANING SYSTEM FOR A CHARGING DEVICE IN A XEROGRAPHIC PRINTER

CROSS-REFERENCE TO RELATED APPLICATION

Cross-reference is hereby made to the following patent application, being filed simultaneously herewith: CLEANING SYSTEM FOR REMOVING DENDRITES FROM A CHARGING DEVICE IN A XEROGRAPHIC PRINTER, U.S. Ser. No. 11/228,629; now Publication No. 20070065172, published Mar. 22, 2007.

TECHNICAL FIELD

The present disclosure relates to a xerographic printing apparatus, and specifically to a mechanism for cleaning a charging device associated with the apparatus.

BACKGROUND

In the well-known process of electrostatographic or xerographic printing, an electrostatic latent image is formed on a charge-retentive imaging surface, and then developed with an application of toner particles. The toner particles adhere electrostatically to the suitably-charged portions of the imaging surface. The toner particles are then transferred, by the application of electric charge, to a print sheet, forming the desired image on the print sheet. An electric charge can also be used to separate or "detack" the print sheet from the imaging surface.

For the initial charging, transfer, or detack of an imaging surface, the most typical device for applying a predetermined charge to the imaging surface is a "corotron," of which there are any number of variants, such as the scorotron or dicorotron. Common to most types of corotron is a bare conductor, in proximity to the imaging surface, which is electrically biased and thereby supplies ions for charging the imaging surface. The conductor typically comprises one or more wires (often called a "corona wire") and/or a metal bar forming saw-teeth, the conductor extending parallel to the imaging surface and along a direction perpendicular to a direction of motion of the imaging surface. Other structures, such as a screen, conductive shield and/or nonconductive housing, are typically present in a charging device, and some of these may be electrically biased as well. The corotron will have different design parameters depending on whether it is being used for initial charging, transfer, or detack.

In a practical application of charging devices, dust and other debris may collect in or around the corotron. Clearly, the presence of such material will adversely affect the performance of the corotron, and may cause dangerous arcing conditions. Therefore periodic cleaning of the charging device is often desired, and many schemes exist in the prior art for cleaning the charging device, such as by wiping the corona wire. In high-end printing machines, this wiping may be performed by a motorized wiper that travels along the corotron wire.

U.S. Pat. No. 5,485,255 discloses a wiping mechanism for cleaning a corona wire as well as a scorotron screen, which employs a lead screw.

U.S. Pat. No. 6,449,447 discloses a control system for a wiping mechanism for cleaning a corona wire, in which the wiping process is initiated when arcing conditions are detected in the charge device.

SUMMARY

According to one aspect, there is provided an apparatus useful in electrostatographic printing. A charge device places a charge on an imaging surface, the charging device defining at least one wall surface extending in an extension direction. A shuttle moves along the extension direction, the shuttle including a wiper useful for cleaning the wall surface. A tab is disposed substantially adjacent the wall surface, the tab effectively covering material removed from the wall surface by the cleaning member.

According to another aspect, there is provided a printing apparatus, comprising an imaging member defining an imaging surface. A charge device places a charge on a portion of the imaging surface, the charge device including a corona member and a housing defining a first wall surface extending in an extension direction. A shuttle moves along the extension direction, the shuttle including a wiper for cleaning the corona member and a first scraper useful for cleaning the first wall surface. A substantially electrically insulative tab is disposed substantially adjacent the wall surface, the tab effectively covering material removed from the wall surface by the cleaning member.

DETAILED DESCRIPTION

Figure 1:
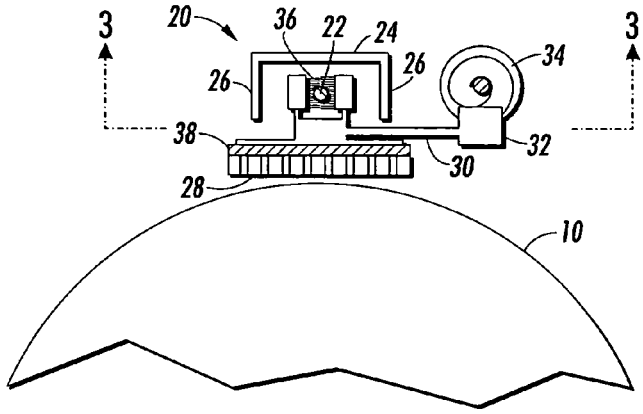
FIG. 1 is an elevational view of a charging device associated with an imaging surface.

FIG. 1 is an elevational view of a charging device associated with an imaging surface, as known in the prior art. The imaging surface is shown as formed by a drum photoreceptor 10, although belt photoreceptors and other charge receptors (such as intermediate belts, as used in color printing) are common as well. Disposed near the photoreceptor 10 is a charge device generally indicated as 20, which, depending on a larger context, may be for initial charging, transfer, or detack in a printing process. As mentioned above, charge devices, such as corotrons, scorotrons, dicorotrons, etc., have many design variants, but typically include one or more wires such as 22, a conductive shield and/or nonconductive housing 24 including sidewalls such as 26, as well as a screen 28; each of these elements may be biased as required for a particular purpose.

It is also known to provide a "pin array", which includes a set of pins or saw-teeth in lieu of a wire; herein, such wires, screens, pin sets, etc. can be generally called an "corona member", even if it is not biased in a particular application. As shown, wire 22 extends parallel to the imaging surface formed by photoreceptor 10, and perpendicular to a direction of rotation or motion of photoreceptor 10.

Figure 2:
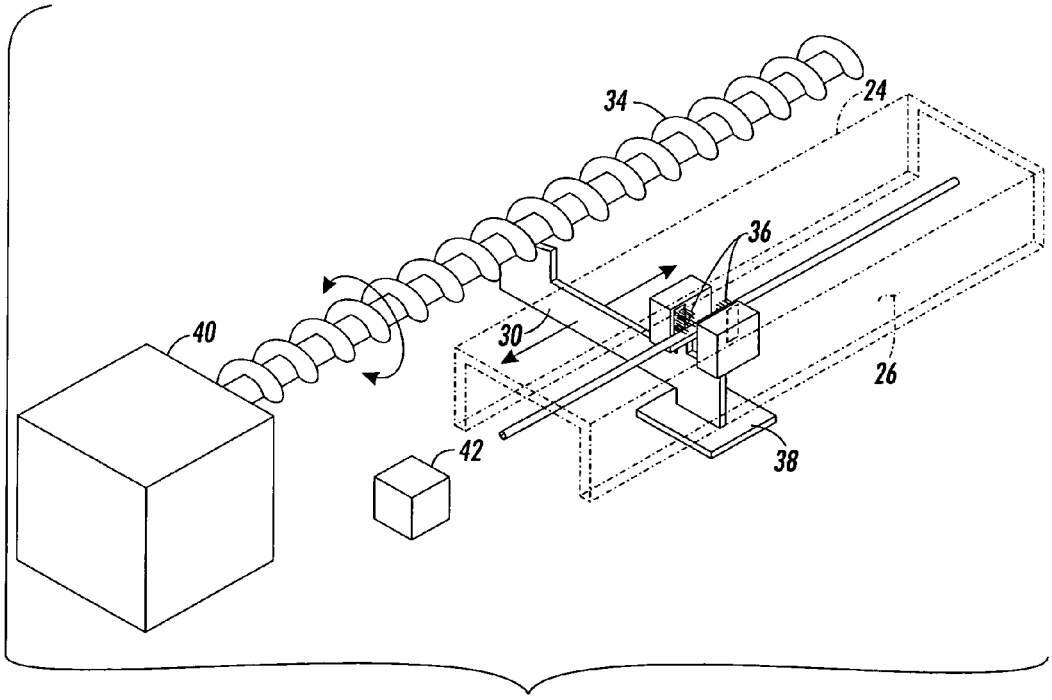
FIG. 2 is a perspective view showing, in isolation, essential parts of the wiping mechanism for a charging device.

When it is desired to clean wires 22, 24, or screen 28, there is provided what is here generally called a "shuttle" 30. With further reference to FIG. 2, shuttle 30 is a piece which includes a tooth 32 which interacts with the windings of a lead screw 34; shuttle 30 further includes a wiper 36 for cleaning wire 22 and 24 and wiper 38 which cleans screen 38. Various configurations and materials for such wipers 36 and 38 are known in the art.

As can be seen in FIG. 2, shuttle 30 interacts with lead screw 34 so that, when lead screw 34 is rotated in a particular direction, the shuttle 30 travels along the lead screw, whereby a wiper such as 36 or 38 can wipe or clean the wire 22 and screen 28. The lead screw 34 is here rotated by a motor 40, which can rotate the lead screw in either direction. (In a practical embodiment, there may also be any number of guide rails or other surfaces, not shown, to facilitate proper motion of the shuttle 30.) Although the present embodiment includes a lead screw, other mechanisms for moving the shuttle 30 along the wires 22, 24 can be used, such as a linear motor, or other mechanisms for converting the rotational motion of a motor such as 40 to linear motion, such mechanisms including pulleys, belts, racks, etc.

Figure 3:
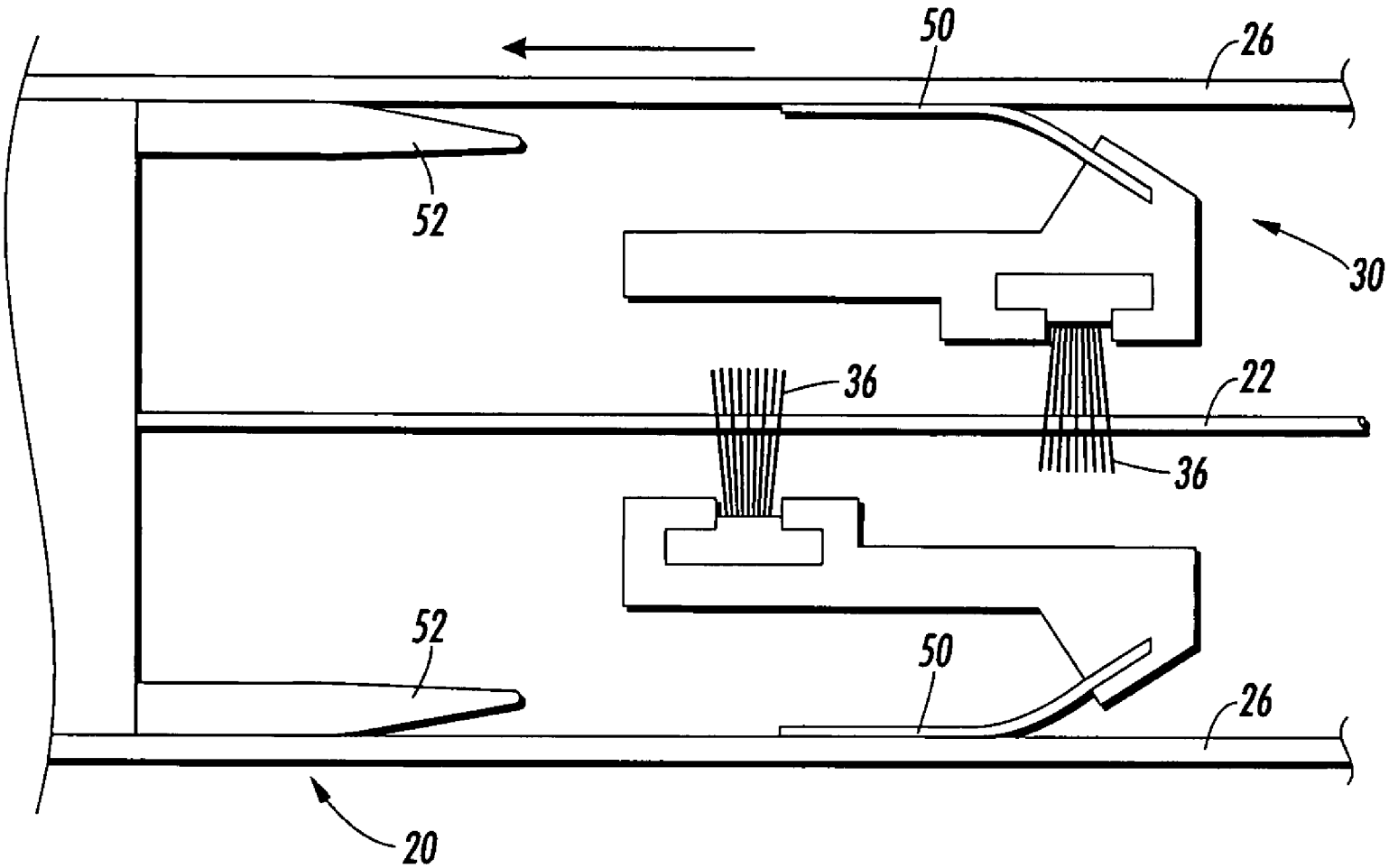
FIG. 3 is a plan view, such as shown by arrow 3 in FIG. 1, of a shuttle movable within a housing of a charge device.

FIG. 3 is a plan view, such as shown by arrow 3 in FIG. 1, of a shuttle 30 movable within housing 24 of charge device 20 (only a portion of the entire length of charge device 20 is shown). Disposed on the shuttle 30 and moveable therewith are two scrapers, each indicated as 50. Each scraper 50 contacts a portion of the inner surface of an adjacent sidewall 26. In one embodiment, each scraper 50 is largely made of a flexible material, such as Mylar® or of a thin strip of metal such as copper and is mounted on shuttle 30 to exhibit a natural resiliency, causing the scraper 50 to be urged against sidewall 26. When shuttle 30 is moved along the length of charge device 20, each scraper 50 scrapes residual toner and any other material from the inner surface of sidewall 26. (As used herein, terms such as "scraping" or "wiping" should be construed broadly, to include any physical action that affects the location of small particles relative to a surface.) The resilient property of multiple scrapers 50 can also have an effect of centering the shuttle 30 within its path along charge device 20.

During a cycle of operation of shuttle 30, as described above, when the shuttle 30 is moved first in one direction along the charge device 20 and then returns, the scrapers 50 rub the length of each sidewall 26. Near the home position of shuttle 30, the toner and other dirt scraped by the scrapers tends to accumulate in a small pile clinging to a small area of each sidewall 26 where the shuttle comes to a stop. As a practical matter, the presence of this small pile of scraped material presents an opportunity for undesirable arcing between wire 22 and sidewall 26.

Further shown in FIG. 3 are two tabs, each indicated as 52, which are each disposed generally adjacent a sidewall 26 near a stop position of shuttle 30 within charge device 20. Each tab 52 is configured to accept a tip or other portion of the scraper 50 so that the scraper 50 will push any stray toner or dirt between the tab 52 and the sidewall 26. In effect, each tab 52 covers the accumulated material. In one embodiment, tab 52 includes an electrically insulative material so as to suppress any opportunity for arcing between a pile of material between it and sidewall 26 and any other member, such as wire 22.

In a practical application, each tab 52 is configured to retain a certain quantity of accumulated material "underneath" it, so that the accumulated material can be removed by external means, such as overall cleaning of the charge device 20, with the normal frequency of maintenance on the printing machine in general. It is conceivable, however, that accumulated material associated with each tab 52 could be periodically or continuously removed by means "on-board" the printing machine, such as a brush mechanism (not shown) or airflow provided near the tab 52.

Figure 4:
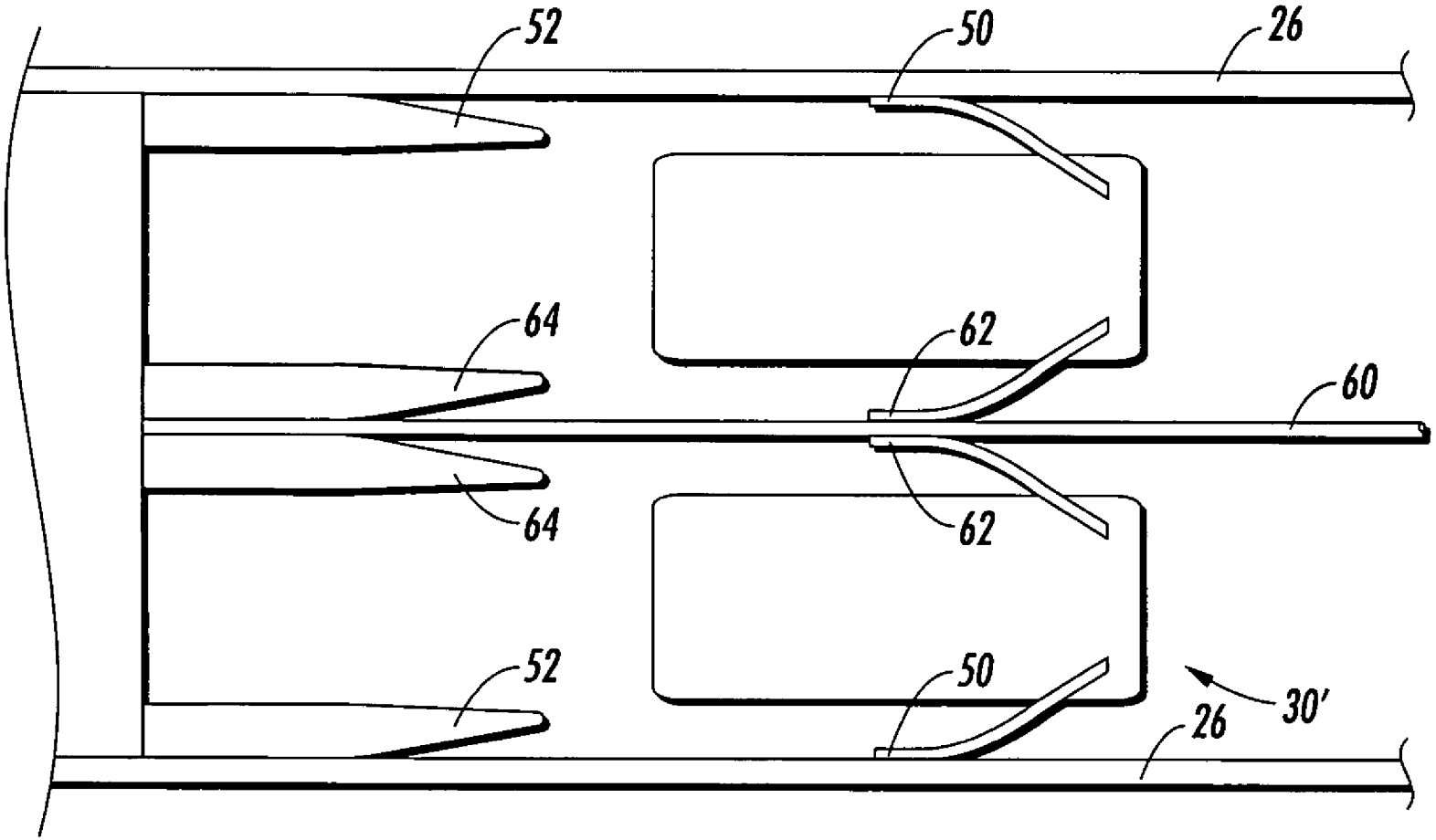
FIG. 4 is a plan view, similar to FIG. 3, showing a charge device having a pin array.

FIG. 4 is a plan view, similar to FIG. 3, showing a charge device 20 having a pin array 60 that can be used as a corona-generating member instead of the wire 22 described above. (The pins of pin array 60 would be coming out of the page in the view of FIG. 4.) Since a pin array such as 60 is typically made from a flat strip of metal, the pin array is likely to have "sidewalls" as well. These sidewalls can be cleaned by scrapers 62 analogous of the scrapers 50 described above, and there can be disposed at the end of pin array 60 tabs 64 analogous in function to the tabs 52 described above.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An apparatus useful in electrostatographic printing, comprising:

a charge device for placing a charge on an imaging surface, the charging device defining at least one side wall surface extending in an extension direction, said side wall surface defining the exterior of the charging device;

a shuttle movable along the extension direction, the shuttle including a scraper urged against the side wall surface; and a tab disposed near a stop position of the shuttle substantially adjacent the side wall surface, the tab accepting a portion of the scraper and effectively covering against a portion of the side wall surface accumulated material removed from the side wall surface by the scraper, wherein said charging device comprises a charging element, which is not cleaned by said scraper, wherein said scraper is disposed between said charging element and said side wall surface.

2. The apparatus of claim 1, the tab being substantially electrically insulative.

3. The apparatus of claim 1, the charging device including a housing, the housing defining a wall surface.

4. The apparatus of claim 1, the charging device including a pin array, the pin array defining a wall surface.

5. The apparatus of claim 1, further comprising an imaging member defining an imaging surface disposed adjacent the charge device.

6. The apparatus of claim 5, wherein the imaging member comprises a photoreceptor.

7. The apparatus of claim 5, wherein the charge device performs at least one of initial charging, transfer, and detack relative to the imaging member.

8. A printing apparatus, comprising:

an imaging member defining an imaging surface;

a charge device for placing a charge on a portion of the imaging surface, the charge device including a corona member and a housing defining a first side wall surface extending in an extension direction, said first side wall surface defining the exterior of the charging device;

a shuttle movable along the extension direction, the shuttle including a wiper for cleaning the corona member and a first scraper useful for cleaning the first side wall surface; and a substantially electrically insulative tab disposed near a stop position of the shuttle substantially adjacent the side wall surface, the tab accepting a portion of the scraper and effectively covering against a portion of the side wall surface accumulated material removed from the wall surface by the scraper, wherein said charging device comprises a charging element, which is not cleaned by said scraper, wherein said scraper is disposed between said charging element and said side wall surface.

9. The apparatus of claim 8, the charge device defining a second wall surface, and the shuttle including a second scraper useful for cleaning the second wall surface.

10. The apparatus of claim 8, the charging device including a pin array, the pin array defining a wall surface.

11. The apparatus of claim 8, the wiper including a member urged against the wall surface.

12. The apparatus of claim 8, wherein the charge device performs at least one of charging, transfer, and detack relative to the imaging member.

* * * * *